United States Patent [19]

Kameda

[11] 4,248,405

[45] Feb. 3, 1981

[54] LIFTING JACK

[76] Inventor: Tamotsu Kameda, 2594-5 Omiya, Fujinomiya-shi, Japan

[21] Appl. No.: 104,041

[22] Filed: Dec. 17, 1979

[30] Foreign Application Priority Data

Dec. 22, 1978 [JP] Japan ..... 53-160760

[51] Int. Cl.[3] ..... B66F 5/02

[52] U.S. Cl. ..... 254/10 B

[58] Field of Search ..... 254/2 B, 8 B, 9 B, 10 B, 254/93 R, 124, 126

[56] References Cited

U.S. PATENT DOCUMENTS

| | | | |
|---|---|---|---|
| 2,402,572 | 6/1946 | Page | 254/10 B |
| 2,587,067 | 2/1952 | Sachtleber | 254/8 B |
| 3,632,085 | 1/1972 | Traywick | 254/10 B |

*Primary Examiner*—Robert C. Watson

*Attorney, Agent, or Firm*—John Cyril Malloy

[57] ABSTRACT

A lifting jack for vehicles having three sets of parallelogram linkages in itself for a substantially vertical or, alternatively, forwardly slanted motion of a lifting head is provided so as to reduce the hazard of a vehicle falling off a lifting head due to slippage between the lifting head and the portion of the vehicle bottom at which the lifting head is applied. The lifting head of conventional swing arm type lifting jacks usually moves backward, or away from the vehicle, as it is elevated while the portion of the vehicle bottom at which the lifting head is applied usually moves forward, or away from the lifting jack, as the vehicle is lifted up.

7 Claims, 4 Drawing Figures

LIFTING JACK

The present invention relates to a lifting jack for vehicles, or, in particular, to a lifting jack of an improved swing arm type.

Lifting jacks of a swing arm type are very widely used in garages or repair shops for cars and trucks. In a front portion of a swing arm type lifting jack, there is a lifting head attached to an end of a swing arm having its center of swing motion in a rear portion of the lifting jack. To the rear most end of the jack, a handle bar is attached. An operator, holding this handle bar, may either pull or push the jack so as to place it exactly under a portion of a car bottom at which he wishes to apply the lifting head.

As the lifting head is elevated, it follows an arcuate path with its center located in a rear portion of the jack. In other words, the motion of the lifting head, as it is being elevated, is not exactly vertical but contains some horizontal component which is directed backward or toward the operator.

On the other hand, the portion of the car bottom at which the lifting head is applied moves forward or away from the lifting jack as it is lifted up because the car also is subjected to a swing motion, similar to that of the swing arm of the lifting jack, with its center located on the set of car wheels which are not lifted off the ground and usually restrained from making a rolling or slipping motion by an appropriate means. Therefore, if both the car and the lifting jack are prevented from travelling on the floor, there necessary arises some slippage between the lifting head and the portion of the car bottom at which the lifting head is applied. And, this slippage is particularly dangerous because car bottom surface is usually very irregular and the places where a lifting head may be safely applied are very limited. A car often falls off from the lifting head under these circumstances. People working near the car may sometimes get injured.

To prevent such a hazard, most lifting jacks of this type are provided with a set of wheels by which they may be freely movable on the floor. On account of these wheels, the lifting jack usually moves toward the car or away from the operator as its lifting head lifts up the car, thereby eliminating the hazardous slippage between the lifting head and the portion of the car bottom at which the lifting head is applied.

However, the wheels of a lifting jack are relatively small in size so that the jack may be usable even in a very restricted space, they tend to be unreliable. If, for example, one of the bearing of the wheels is not in a good condition or the floor is not smooth enough, there always is a danger of a car falling off the lifting head and consequent possible injuries to people working nearby.

To circumvent such a shortcoming, there are other types of lifting jacks which are capable of substantially vertical motion of their lifting heads. For example, there are a lifting jack consisting of a screw and a rhombic linkage, a lifting jack which directly uses a linear motion of a hydraulic piston in a hydraulic cylinder, etc. However, these lifting jacks are not without one or more of other shortcomings. Some of them are not provided with a sufficient lifting stroke as desired, and others are not provided with a sufficiently low profile to be usable under a car having a relatively low floor. And, also, a lifting jack is preferred to be maneuverable.

A primary object of the present invention is to provide a lifting jack which has the advantages of a conventional swing arm type lifting jack and capable of substantially vertical motion of its lifting head.

Another object of the present invention is to provide a lifting jack whose lifting head is given with a forward motion as it is elevated so as to compensate for the tendency of a vehicle bottom, at which the lifting head is applied, to move forwad or away from the lifting jack.

Still another object of the present invention is to provide a lifting jack which has most of the usefulness of conventional lifting jacks. In other words, there is provided a lifting jack having a sufficiently low profile to be usable for a vehicle of a relatively low floor, a sufficiently large lifting stroke for most needs, and a sufficient maneuvability.

Further objects, details and benefits of the present invention will become more clear from the following description of preferred embodiments, and the accompanying drawings, which, however, should not be taken as limitative of the present invention, but which are given for the purpose of illustration only. In the drawings.

Figure 1:
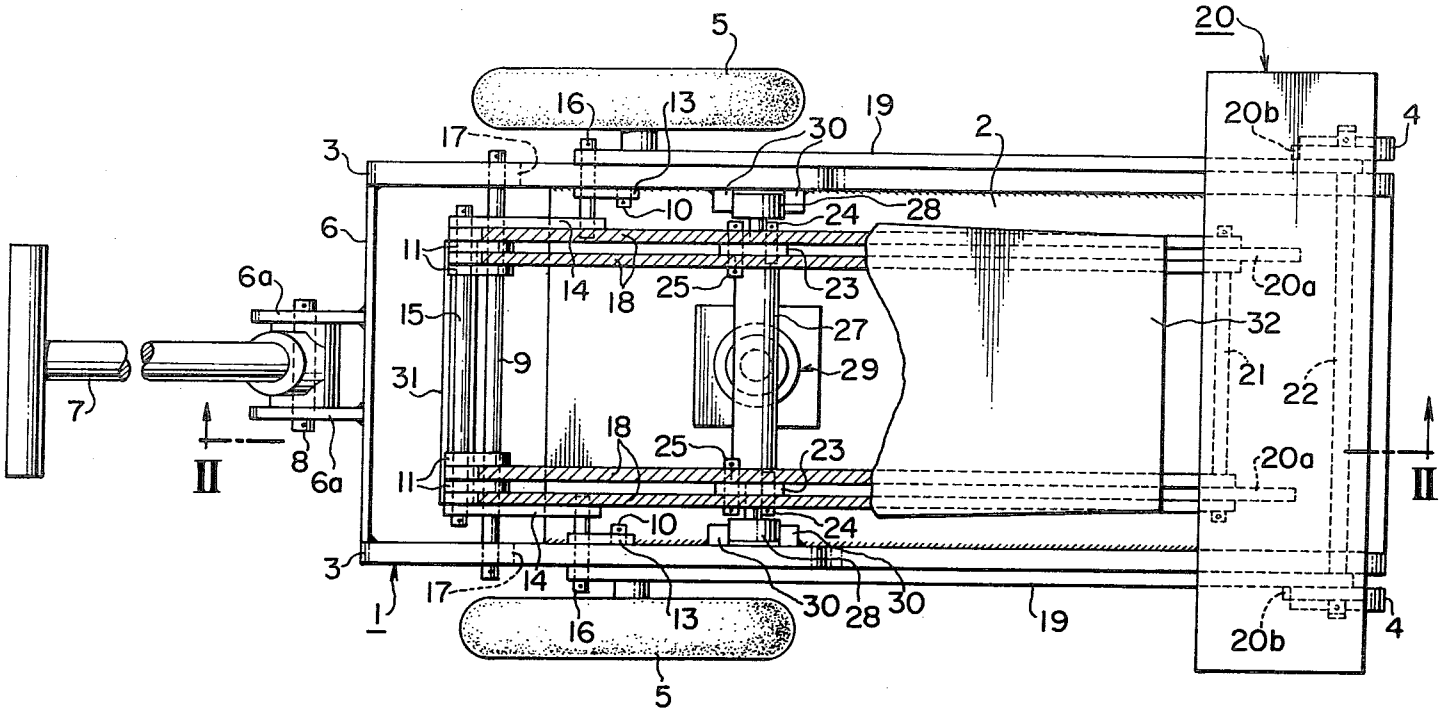
FIG. 1 is a partly broken away schematic plan view of a preferred embodiment according to the present invention.
Figure 2:
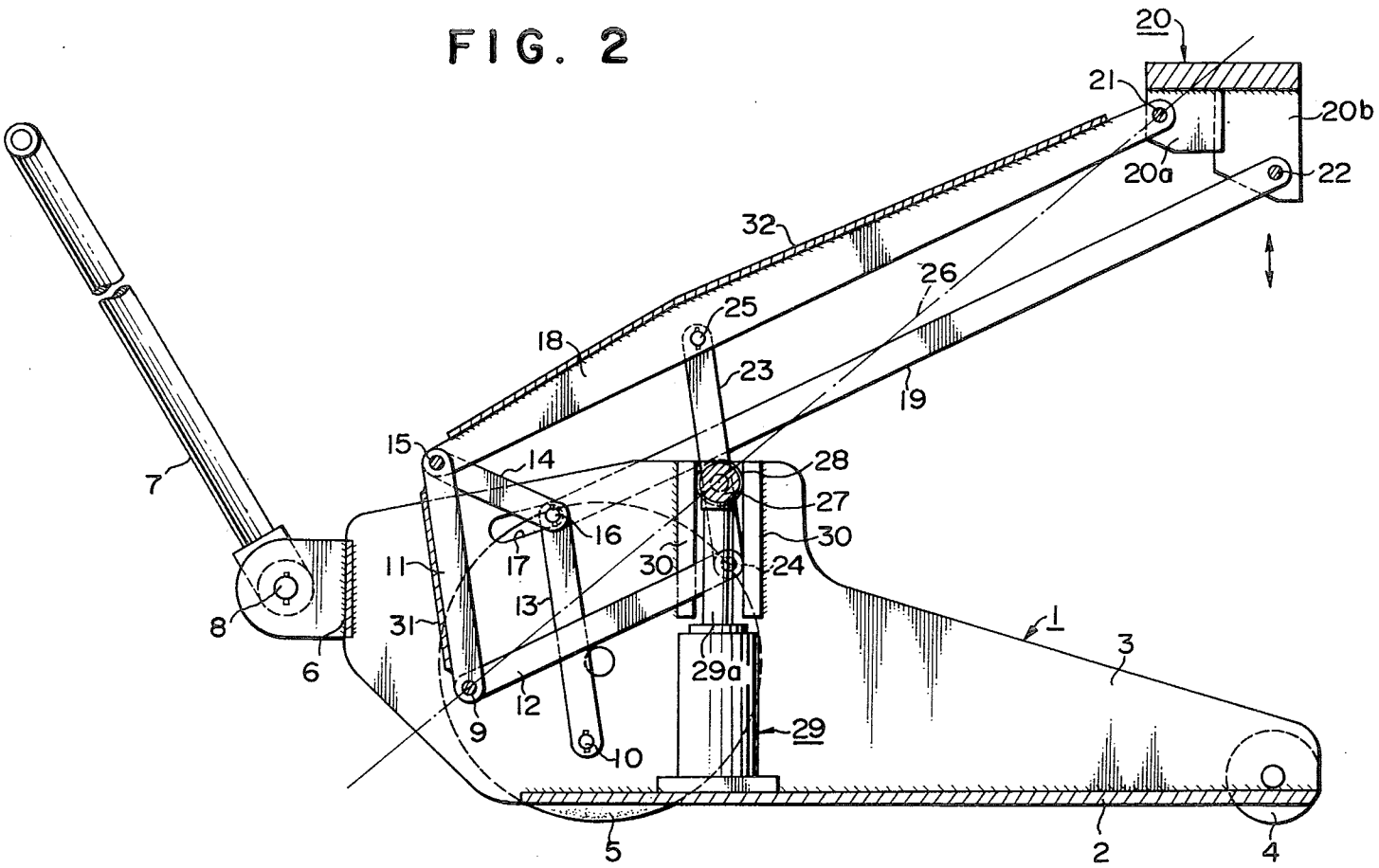
FIG. 2 is a longitudinal sectional view along the line II—II of FIG. 1.
Figure 3:
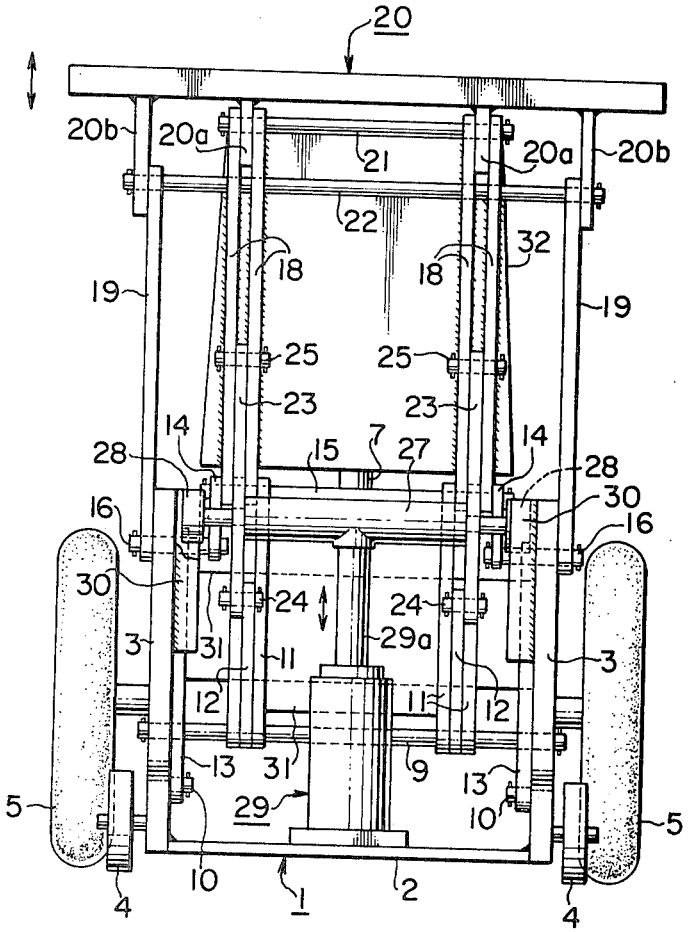
FIG. 3 is an elevational end view of the lifting jack in FIGS. 1 and 2 seen from its front end.

Referring to FIGS. 1 through 3, in particular to FIG. 2, a chassis generally designated as 1 comprises a bottom plate 2 and a pair of side plates 3. A pair of front and rear wheels 4 and 5 are provided on the outside of the side plates 3 near their extreme ends.

Figure 4:
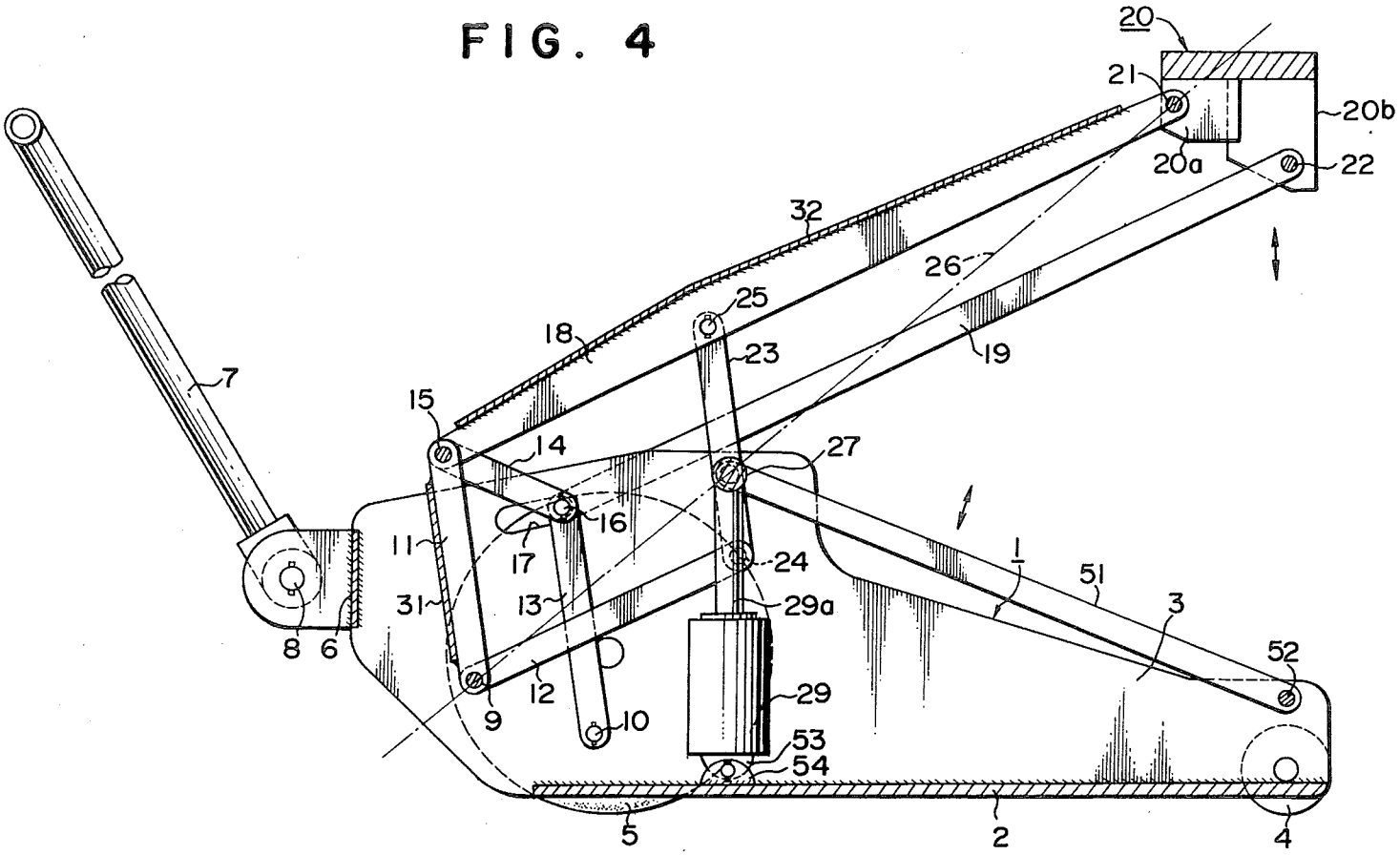
FIG. 4 shows another preferred embodiment according to the present invention in a similar way as in FIG. 2.

Since this lifting jack is symmetrical about its longitudinal center line, only half of it is shown in FIGS. 2 and 4, and the following explanation also will be made in reference to only the halves shown in FIGS. 2 and 4 for the convenience of illustration and explanation.

The side plate 3 is further reinforced by an end plate 6 connecting it to the other one on the rear of the jack. And brackets 6 *a* are provided for attaching, by means of a pivot shaft 8, a handle bar 7 which is provided for moneuvering of the jack and installing controll means (not shown in the drawings) for a lifting means in the main body of the jack.

In a rear potion of the chassis 1, a pivot shaft 9 is mounted across the two side plates 3 and a pivot pin 10 is mounted to the side plate 3 slightly forward and downward of the chassis with respect to the pivot pin 9.

To the pivot shaft 9 is attached a link member 12 extending upward and forward and link member 11 extending upward and backward. And, to the pin 10 mounted on the side plate 3 is attached a link member 13 which has the same length as the link member 11 and is extending parallel to it.

The upper ends of the link members 11 and 13 are connected by another link member 14 having the same length as the distance between the pivot shaft 9 and the pivot pin 10. The pivot shaft 15, which connects the link members 11 and 14, is further connected to a long swing arm 18 which extends forward and upward. And the pivot pin 16, which connects the link members 13 and 14, is guided by an arcuate slot 17 which is provided in the side plate 3 and extends in a substantially horizontal direction. And the pivot pin 16 is further connected to a swing arm 19 which has the same length as the previously mentioned swing arm 18 and extends parallel to it.

The free end of the long swing arms 18 and 19 are pivotally connected to a lifting head by means of brackets 20*a* and 20*b* and pivot shafts 21 and 22, respectively. The distance between the pivot shafts 21 and 22 is selected to be the same as the distance between the pivot shaft 15 and the pivot pin 16.

The symmetrical pairs of the link members 11 and the swing arms 18 are respectively connected to each other by plates 31 and 32 for reinforcement.

Connected to the front end of the link member 12, by a pivot pin 24, is a link member 23 whose other end is connected to an intermediate point of the swing arm 18 with a pivot pin 25. The link member 23 has the same length as the link member 11 and is parallel to it. Furthermore, the link member 23 is penetrated through by a power shaft 27 in its intermediate point lying on a line connecting the pivot shafts 9 and 21. The pivot shaft 27 is further provided with a guide roller 28 on each of its ends guided by a guide member 30 consisting of a pair of rails between which the guide roller 28 is slidably engaged. The roller 28 is constrained to make only a vertical motion by the guide member 30. And the mid point of the power shaft 27 is connected to an operating end of a hydraulic piston 29*a* coming out of a hydraulic cylinder 29. The lower end of the hydraulic cylinder is formed as a trunnion 53 which in turn is pivotably attached to the bottom plate 2 with brackets 54.

When the hydraulic piston 29*a* is elevated or lowered in its cylinder 29, the lifting head 20, which is connected to the ends of the swing arms 18 and 19, is correspondingly elevated or lowered, as the case may be, at a magnified rate.

In the above described linkage mechanism, there are three parallelogram linkages, the first one consisting of the two swing arms, the link member 14 and the lifting head 20 the second one consisting of the link members 11, 13 and 14 and a part of the side plate 3, and the third one consisting of the link members 11, 12 and 23 and the lower potion of the swing arm 18.

In other words, the first parallelogram linkage has its four pivots at 15, 16, 21, and 22, the second parallelogram linkage has its four pivots at 9, 15, 16 and 10, and the third parallelogram linkage has its four pivots at 9, 15, 25 and 24.

Therefore, a line connecting 21 and 22 is always parallel to a line connecting 9 and 10, and the lifting head 20 keeps its horizontal orientation at any height.

And, since the power shaft 27, which is directly connected to the lifting means, lies on the line connecting the pivot shafts 21 and 9 and the link members 11 and 23 are parallel to each other, the motion of the pivot shaft 21 is parallel to the vertical motion of the power shaft 27. Furthermore, the motion of the power shaft 27 is transmitted to the pivot shaft 21 magnified by the ratio of the distance between 9 and 21 to the distance between 9 and 27.

Thus, as the lifting means or the hydraulic piston 29*a* lifts the power shaft 27, the lifting head 20 moves vertically at a magnified rate and the horizontal relative displacement between the lifting head 20 and a vehicle bottom, to which the lifting jack is applied, now becomes solely due to the horizontal displacement of the vehicle. Consequently, the risk of the vehicle falling off from the lifting head 20 may be made considerably smaller.

Moreover, if the guide members 30 which were described as being vertical in the above explanation may be tilted forward so as to produce a motion of the lifting head 20 likewise tilted forward thereby compensating for the tendency of the vehicle bottom to move forward as it is lifted up.

In the above described embodiment, the lifting means was consisting of a hydraulic piston 29*a* and a hydraulic cylinder 29, but it may equally well be a lifting means of a screw or other type. And, the lifting means may be applied to other parts of the linkages, for example, the link member 11 or 12, or the swing arm 18 itself.

FIG. 4 shows another preferred embodiment of the present invention in which, instead of the guide members 30 and the rollers 28, a guide arm 51 is connected to each of the ends of a pivot shaft 27′ similar to the pivot shaft 27. Otherwise, the lifting jack in FIG. 4 is identical to the lifting jack in FIG. 2.

In this case, since the guide arm 51 undergoes a swing motion with its center located at a pivot shaft 52, the pivot shaft 27′ follows an arcuate path curving to forward as it is lifted up by the lifting means. Therefore, the lifting head also will follow an arcuate path curving to forward as it is lifted up. In this second preferred embodiment, an effect similar to the one obtained in the first embodiment when the guide members 30 are attached in a forwardly tilting manner may be obtained.

Also, the possible horizontal displacement of the lifting head 20 of the second embodiment may be controlled by adjusting the length of the guide arm 51 or/and the height of the pivot shaft 52.

Although, the present invention was shown and described with respect to particular preferred embodiments thereof, it should be understood that various changes and modifications of the form and the details thereof could be made without departing from the spirit of the invention. Therefore, it should be understood that the protection and monopoly afforded should not be limited by any details of the embodiments given, but only by the appended claims.

What is claimed is:

1. A lifting jack, comprising:

a chassis having;

a pair of horizontally spaced parallel and vertical side plates, a set of wheels spanning said chassis at each end of said side plates, and a transverse brace member connecting said side plates, a lifting means mounted on said chassis, an elevating linkage having;

a lifting head as its first link, upper and lower swing arms as its second and fourth links, and a third link member, a pivot pin connecting said third and fourth links being guided by an arcuate slot provided in each of said side plates, a second parallelogram linkage having;

a first link member common to said third link of said elevating linkage, and second and fourth link members connected thereto, third link member being in a body with said chassis, and a third parallelogram linkage having;

its first link member formed by a certain length of said third link member of said elevating parallelogram linkage, a second link member in a body with said second link member of said second parallelogram linkage, a third link member, and a fourth link member guided by a guide means in its intermediate point lying on a line connecting a pivot pin between said first and second link members of said first elevating parallelogram linkage and a pivot shaft between said second and third link members of said third parallelogram linkage.

2. A lifting jack according to claim 1, wherein:

said guide means guides said intermediate point of said fourth link member of said third parallelogram linkage along a substantially vertical direction.

3. A lifting jack according to claim 1, wherein:

said guide means guides said intermediate point of said fourth link member of said third parallelogram linkage along a forwardly tilted direction.

4. A lifting jack according to claim 1, wherein:

said guide means comprises a pair of rails attached to each of said side plates and a roller attached to each end of said pivot shaft fixedly penetrating said fourth link member of said third parallelogram linkage at said intermediate point thereof so as to be slidably engaged between said rails.

5. A lifting jack according to claim 1, wherein:

said guide means comprises a guide arm pivotally connected to a pivot shaft provided at said intermediate point of said fourth link member of said third parallelogram linkage for a circuate motion of said intermediate point.

6. A lifting jack according to claim 1, wherein:

said lifting means comprises a hydraulic cylinder and a hydraulic piston therein.

7. A lifting jack according to claim 1, wherein:

said lifting means comprises a screw and a screw nut.

* * * * *